US008115422B2

(12) United States Patent
Sasaki

(10) Patent No.: US 8,115,422 B2
(45) Date of Patent: Feb. 14, 2012

(54) LED DRIVE CIRCUIT

(75) Inventor: Osamu Sasaki, Chiba (JP)

(73) Assignee: Seiko Instruments Inc., Chiba (JP)

( * ) Notice: Subject to any disclaimer, the term of this patent is extended or adjusted under 35 U.S.C. 154(b) by 461 days.

(21) Appl. No.: 12/417,460

(22) Filed: Apr. 2, 2009

(65) Prior Publication Data

US 2009/0295306 A1 Dec. 3, 2009

Related U.S. Application Data

(60) Provisional application No. 61/043,261, filed on Apr. 8, 2008.

(51) Int. Cl.
*H05B 37/02* (2006.01)

(52) U.S. Cl. ..... 315/308; 315/309; 315/316; 315/210

(58) Field of Classification Search ..... 315/247, 315/250, 254, 291, 294, 297, 307; 345/102, 345/211, 690
See application file for complete search history.

(56) References Cited

U.S. PATENT DOCUMENTS

| | | | | |
|---|---|---|---|---|
| 5,508,904 | A * | 4/1996 | Hara | 363/21.11 |
| 7,368,885 | B2 * | 5/2008 | Takeda et al. | 315/308 |
| 2009/0261748 | A1 * | 10/2009 | McKinney et al. | 315/254 |
| 2009/0302779 | A1 * | 12/2009 | McKinney | 315/294 |
| 2010/0177127 | A1 * | 7/2010 | Akiyama et al. | 345/690 |
| 2011/0068703 | A1 * | 3/2011 | McKinney | 315/210 |
| 2011/0068704 | A1 * | 3/2011 | McKinney | 315/210 |

OTHER PUBLICATIONS

Gadre, Dhananjay V., "Buck regulator controls white LED with optical feedback", 5 pages.

* cited by examiner

*Primary Examiner* — Vibol Tan
(74) *Attorney, Agent, or Firm* — Brinks Hofer Gilson & Lione

(57) ABSTRACT

Provided is an LED drive circuit capable of using a switching regulator IC having low breakdown voltage even when a power supply voltage is high. The LED drive circuit includes a voltage clamp circuit for clamping the power supply voltage to an operating voltage of the switching regulator IC, converts an output voltage of a current detecting circuit for detecting a current flowing through an LED into the operating voltage of the switching regulator IC, and outputs the operating voltage.

4 Claims, 4 Drawing Sheets

LED DRIVE CIRCUIT

RELATED APPLICATIONS

Pursuant to 35 U.S.C. §119(e), this application claims the benefit of the filing date of U.S. Provisional Application Ser. No. 61/043,261 filed on Apr. 8, 2008, which is incorporated herein by reference.

BACKGROUND OF THE INVENTION

1. Field of the Invention

The present invention relates to an LED drive circuit for driving an LED, and more particularly, to an LED drive circuit formed of a constant current circuit using a switching regulator IC.

2. Description of the Related Art

LEDs are used in various electronic devices. There are various drive circuits as an LED drive circuit, and an LED drive circuit formed of a constant current circuit using a switching regulator IC is used as well.

FIG. 7 is a circuit diagram of an LED drive circuit using a conventional step-down switching regulator IC. An LED drive circuit 1 using the conventional step-down switching regulator IC includes a step-down switching regulator IC 2A, a resistor circuit 3 for detecting a current of an LED 10 connected to an output terminal VOUT, and a switching transistor 4, a coil 5, a diode 6, and capacitors 7 and 8 which are external elements of the switching regulator IC 2A. In a case of this circuit, a configuration in which the current of the LED 10 is detected on a terminal VRET side is taken as an example.

FIG. 8 is a circuit diagram of an LED drive circuit for stepping down a power supply voltage to drive an LED using a conventional step-up switching regulator IC. An LED drive circuit 1 using the conventional step-up switching regulator IC includes a step-up switching regulator IC 2B, a resistor circuit 3 for detecting a current of an LED 10 connected to an output terminal VOUT, and a switching transistor 4, a coil 5, a diode 6, and capacitors 7 and 8 which are external elements of the switching regulator IC 2B. In a case of this circuit, a configuration in which the current of the LED 10 is detected on the output terminal VOUT side is taken as an example.

The LED drive circuits 1 as described above cause the LED to emit light by the following operation.

For example, in the LED drive circuit 1 of FIG. 7, the switching regulator IC 2A controls on/off of the switching transistor 4, and causes a current generated in the coil 5 to flow from the output terminal VOUT to the LED 10. An output current of the output terminal VOUT generates a voltage by flowing through the resistor circuit 3. The voltage in proportion to the output current is input to an FB terminal of the switching regulator IC 2A. The switching regulator IC 2A controls on/off of the switching transistor 4 so that the voltage becomes constant. Accordingly, the LED 10 emits light with constant luminance.

The LED drive circuit 1 of FIG. 8 also causes the LED 10 to emit light with constant luminance by the similar operation.

In a market, there is such a demand that the LED drive circuit is driven by power supply obtained by directly rectifying a commercial AC power supply, for example, by power supply of DC 100 V which is converted from AC 100 V.

However, the above-mentioned LED drive circuits 1 each have a circuit configuration in which a power supply voltage is directly applied to a power supply terminal Vdd of the switching regulator IC. Accordingly, the LED 10 cannot be driven by a power supply voltage which is equal to or larger than a breakdown voltage of an IC in the conventional LED drive circuits 1. For example, in the case of a circuit driven by a power supply voltage of 100 V, a switching regulator IC having a breakdown voltage of 5 V cannot be used. In such a case, a switching regulator IC having high breakdown voltage is used or a power supply voltage is stepped down. However, there arises such a problem that the switching regulator IC is costly in the former case while power efficiency deteriorates in the latter case.

SUMMARY OF THE INVENTION

The present invention has been made in view of the above-mentioned problem, and aims to drive an LED without loss of power efficiency even when a power supply voltage exceeds a breakdown voltage of a switching regulator IC.

In order to solve the conventional problem, an LED drive circuit using a switching regulator IC according to the present invention has the following configuration.

The LED drive circuit includes: a voltage clamp circuit for clamping a power supply voltage to an operating voltage of the switching regulator IC; and a current detecting circuit for detecting a current flowing through an LED, and outputting a voltage obtained by converting the detected current into a voltage within a range of the operating voltage of the switching regulator IC.

With the above-mentioned configuration, the LED drive circuit according to the present invention is capable of setting a voltage within a range of an operating voltage of the switching regulator IC by the voltage clamp circuit even when a voltage of a power supply is 100 V, and setting the voltage output from the current detecting circuit within the range of the operating voltage of the switching regulator IC. Accordingly, a switching regulator IC having low breakdown voltage can be used for the LED drive circuit, and thus the LED drive circuit can be configured at low cost.

DETAILED DESCRIPTION OF THE PREFERRED EMBODIMENTS

First Embodiment

Figure 1:
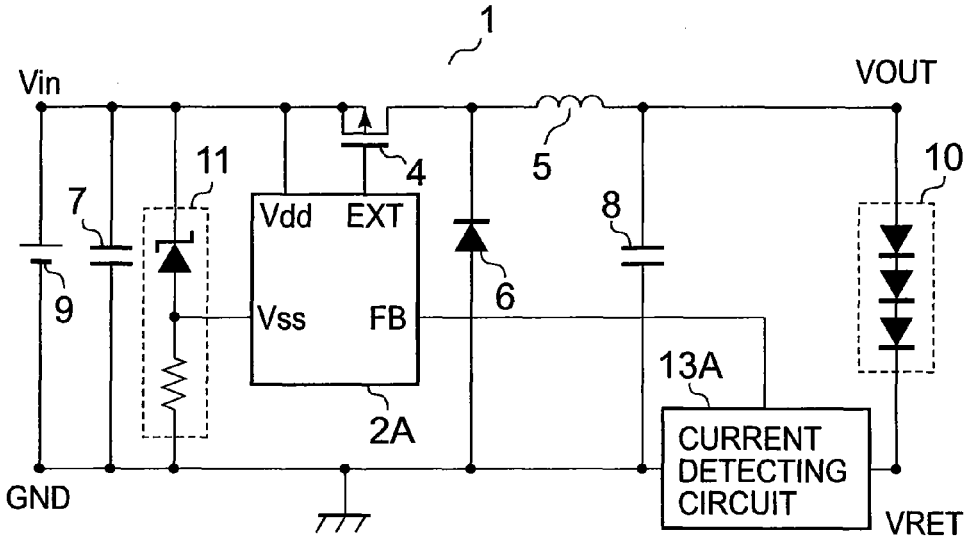
FIG. 1 is a circuit diagram of an LED drive circuit using a step-down switching regulator IC according to a first embodiment of the present invention.

FIG. 1 is a circuit diagram of an LED drive circuit using a step-down switching regulator IC according to this embodiment.

An LED drive circuit 1 according to this embodiment includes: a power supply 9; a step-down switching regulator IC 2A; a coil 5, a diode 6, capacitors 7 and 8 which are external elements of the switching regulator IC 2A; a switching transistor 4; an LED 10; a voltage clamp circuit 1; and a current detecting circuit 13A.

The power supply 9 is connected between a power supply input terminal Vin and a power supply input terminal GND. The switching regulator IC 2A includes a power supply terminal Vdd connected to the power supply input terminal Vin, a power supply terminal Vss connected to an output terminal of the voltage clamp circuit 11, an output terminal EXT connected to a gate of the switching transistor 4, and an FB terminal connected to an output terminal of the current detecting circuit 13A. The switching transistor 4 and the coil 5 are connected in series between the power supply input terminal Vin and an output terminal VOUT. The LED 10 is connected between the output terminal VOUT and a terminal VRET. The current detecting circuit 13A is connected between the terminal VRET and the power supply input terminal GND. The voltage clamp circuit 11 is connected between the power supply input terminal Vin and the power supply input terminal GND.

The switching regulator IC 2A and the external elements thereof input a feedback voltage based on an output current of the output terminal VOUT to the FB terminal, and control the switching transistor 4 so that a current flowing through the LED 10 becomes constant. The voltage clamp circuit 11 clamps a voltage applied between the power supply terminals Vdd and Vss of the switching regulator IC 2A. That is, only a clamp voltage is applied by a zener diode between the power supply terminals Vdd and Vss. The current detecting circuit 13A has a function of inputting a voltage for controlling the output current to the FB terminal of the switching regulator IC 2A operated by the clamp voltage of the zener diode.

The voltage clamp circuit 11 includes the zener diode and a resistor which are connected in series between the power supply input terminals Vin and GND of the power supply 9 of the LED drive circuit 1. For example, it is assumed that a voltage of the power supply 9 is 100 V and an operating voltage of the switching regulator IC 2A is 5 V. In a case of the voltage clamp circuit 11 of FIG. 1, a voltage of 100 V is input to the power supply terminal Vdd of the switching regulator IC 2A, while a voltage of 95 V which is clamped by the voltage clamp circuit 11 is input to the power supply terminal Vss. That is, a voltage of 5 V is applied between the power supply terminals Vdd and Vss of the switching regulator IC 2A. Accordingly, even when the power supply voltage is 100 V, the LED drive circuit 1 can be configured by using the switching regulator IC 2A which has an operating voltage of 5 V.

Here, the current detecting circuit 13A is provided between the terminal VRET to which the current flowing through the LED 10 returns and the power supply input terminal GND. The switching regulator IC 2A operates with a voltage of the power supply input terminal Vin as a reference, and thus the current detecting circuit 13A detects the current flowing through the LED 10, converts the detected current into a voltage with the voltage of the power supply input terminal Vin as the reference, and outputs the converted voltage.

Figure 2:
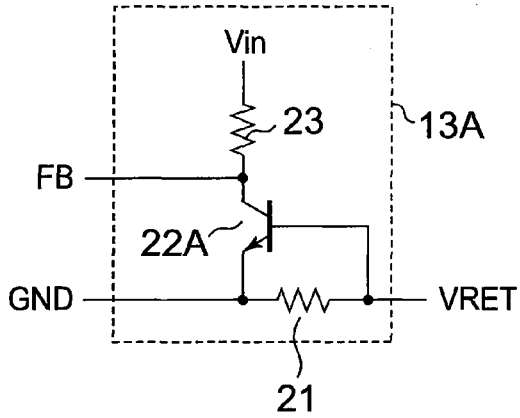
FIG. 2 is a circuit diagram illustrating an example of a current detecting circuit used for the LED drive circuit of FIG. 1 according to the first embodiment.

FIG. 2 illustrates an example of the current detecting circuit used for the LED drive circuit of FIG. 1. The current detecting circuit 13A includes a current detecting resistor 21, an NPN bipolar transistor 22A including an emitter and a base which are connected to both ends of the current detecting resistor 21, and a resistor 23 connected between a collector of the bipolar transistor 22A and the power supply input terminal Vin.

The current detecting circuit 13A is configured in this manner, and hence a high power supply voltage can be applied between the collector and the emitter of the bipolar transistor 22A. As a result, the current detecting circuit 13A can convert a voltage to be output into a voltage within a range of the operating voltage of the switching regulator IC 2A with 100 V as the reference, and output the converted voltage.

Figure 3:
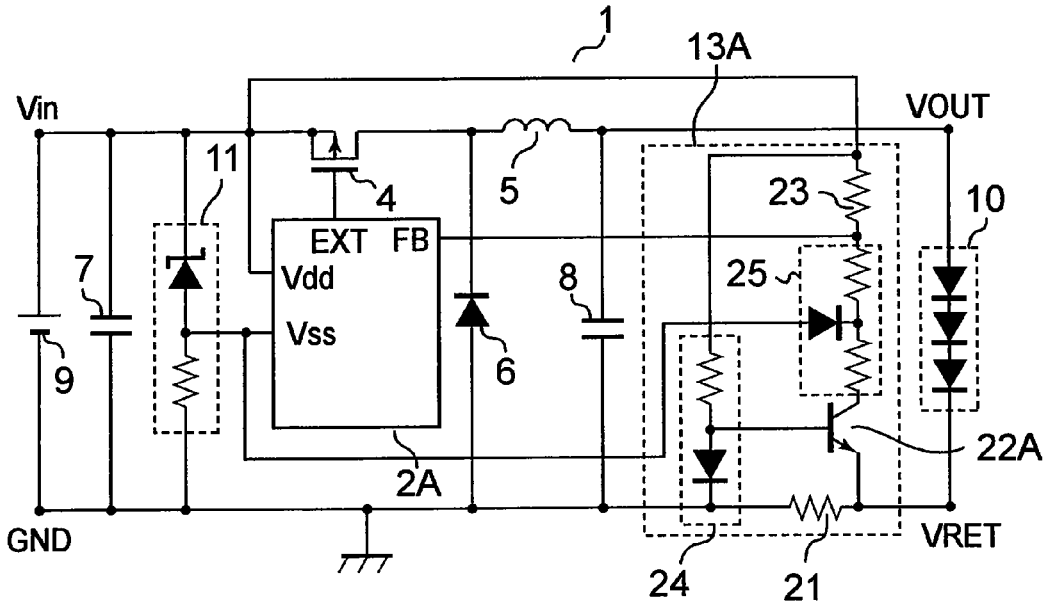
FIG. 3 is a circuit diagram illustrating a specific example of the LED drive circuit using the step-down switching regulator IC according to the first embodiment.

FIG. 3 illustrates a specific example of the LED drive circuit 1 using the step-down switching regulator IC 2A according to this embodiment. The current detecting circuit 13A of FIG. 3 is an example in which the current detecting circuit 13A of FIG. 2 is illustrated more specifically. The current detecting circuit 13A of FIG. 3 includes a bias circuit 24 and a voltage setting circuit 25. The bias circuit 24 includes a diode and a resistor, and applies a bias voltage to the base of the bipolar transistor 22A. The voltage setting circuit 25 includes a diode and resistors. The diode includes an anode terminal connected to the power supply terminal Vss, and has a function of accurately setting a voltage range of the voltage output from the current detecting circuit 13A.

The LED drive circuit 1 is configured in this manner, and thus, even when the voltage of the power supply 9 is 100 V, can set the voltage within a range of the operating voltage of the switching regulator IC 2A by the voltage clamp circuit 11. In addition, the LED drive circuit 1 can set the voltage output from the current detecting circuit 13A within the range of the operating voltage of the switching regulator IC 2A. Accordingly, the LED drive circuit 1 can use the switching regulator IC 2A having low breakdown voltage, whereby the LED drive circuit 1 can be manufactured at low cost.

Second Embodiment

Figure 4:
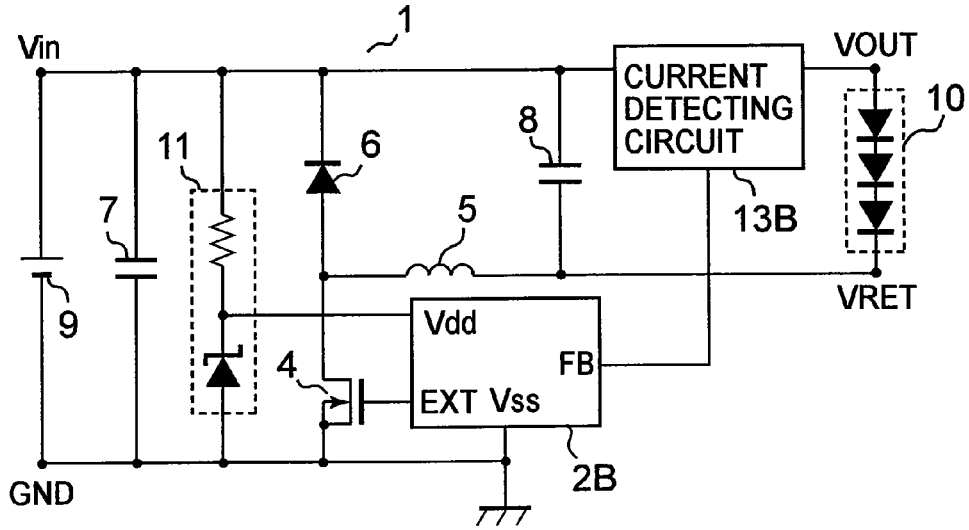
FIG. 4 is a circuit diagram of an LED drive circuit using a step-up switching regulator IC according to a second embodiment of the present invention.

FIG. 4 is a circuit diagram of an LED drive circuit using a step-up switching regulator IC according to this embodiment.

An LED drive circuit 1 according to this embodiment includes: a power supply 9; a step-up switching regulator IC 2B; a coil 5, a diode 6, capacitors 7 and 8 which are external elements of the switching regulator IC 2B; a switching transistor 4; an LED 10; a voltage clamp circuit 11; and a current detecting circuit 13B.

The power supply 9 is connected between a power supply input terminal Vin and a power supply input terminal GND. The switching regulator IC 2B includes a power supply terminal Vdd connected to an output terminal of the voltage clamp circuit 11, a power supply terminal Vss connected to the power supply input terminal GND, an output terminal EXT connected to a gate of the switching transistor 4, and an FB terminal connected to an output terminal of the current detecting circuit 13B. The diode 6 and the switching transistor 4 are connected in series between the power supply input terminal Vin and the power supply input terminal GND. The current detecting circuit 13B is connected between the power supply input terminal Vin and an output terminal VOUT. The LED 10 is connected between the output terminal VOUT and a terminal VRET. The coil 5 is connected between a connection point of the switching transistor 4 and the diode 6, and the terminal VRET. The voltage clamp circuit 11 is connected between the power supply input terminal Vin and the power supply input terminal GND.

The switching regulator IC 2B and the external elements thereof input a feedback voltage based on an output current of the output terminal VOUT to the FB terminal, and control the switching transistor 4 so that a current flowing through the LED 10 becomes constant. The voltage clamp circuit 11 clamps a voltage applied between the power supply terminals Vdd and Vss of the switching regulator IC 2B. That is, only a clamp voltage is applied by a zener diode between the power supply terminals Vdd and Vss. The current detecting circuit 13B has a function of inputting a voltage for controlling the output current to the FB terminal of the switching regulator IC 2B operated by the clamp voltage of the zener diode.

The voltage clamp circuit 11 includes the zener diode and a resistor which are connected in series between the power supply input terminals Vin and GND of the LED drive circuit 1. For example, it is assumed that a voltage of the power supply 9 is 100 V and an operating voltage of the switching regulator IC 2B is 5 V. In a case of the voltage clamp circuit 11 of FIG. 4, a voltage of 0 V is input to the power supply terminal Vss of the switching regulator IC 2B, while a voltage of 5 V which is clamped by the voltage clamp circuit 11 is input to the power supply terminal Vdd. That is, a voltage of 5 V is applied between the power supply terminals Vdd and Vss of the switching regulator IC 2B. Accordingly, even when the power supply voltage is 100 V, the LED drive circuit 1 can be configured by using the switching regulator IC 2B which has an operating voltage of 5 V.

Here, the current detecting circuit 13B is provided between the power supply input terminal Vin and the output terminal VOUT for outputting a current to the LED 10. The switching regulator IC 2B operates with a voltage of the power supply input terminal GND as a reference, whereby the current detecting circuit 13B detects the current flowing through the LED 10, converts the detected current into a voltage with the voltage of the power supply input terminal GND as the reference, and outputs the converted voltage.

Figure 5:
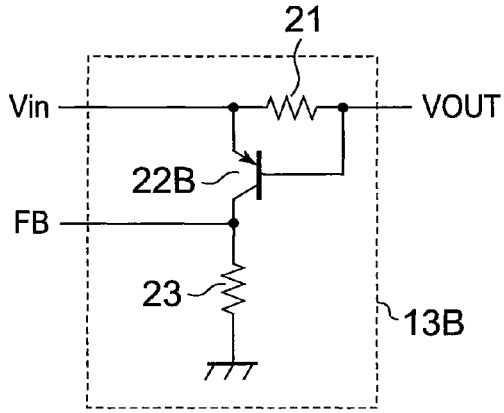
FIG. 5 is a circuit diagram illustrating an example of a current detecting circuit used for the LED drive circuit of FIG. 4 according to the second embodiment.

FIG. 5 illustrates an example of the current detecting circuit 13B used for the LED drive circuit of FIG. 4. The current detecting circuit 13B includes a current detecting resistor 21, a PNP bipolar transistor 22B including an emitter and a base which are connected to both ends of the current detecting resistor 21, and a resistor 23 connected between a collector of the bipolar transistor 22B and the power supply input terminal GND.

The current detecting circuit 13B is configured in this manner, and hence a high power supply voltage can be applied between the collector and the emitter of the bipolar transistor 22B. As a result, the current detecting circuit 13B can convert a voltage to be output into a voltage within a range of the operating voltage of the switching regulator IC 2B with 0 V as the reference, and output the converted voltage.

Figure 6:
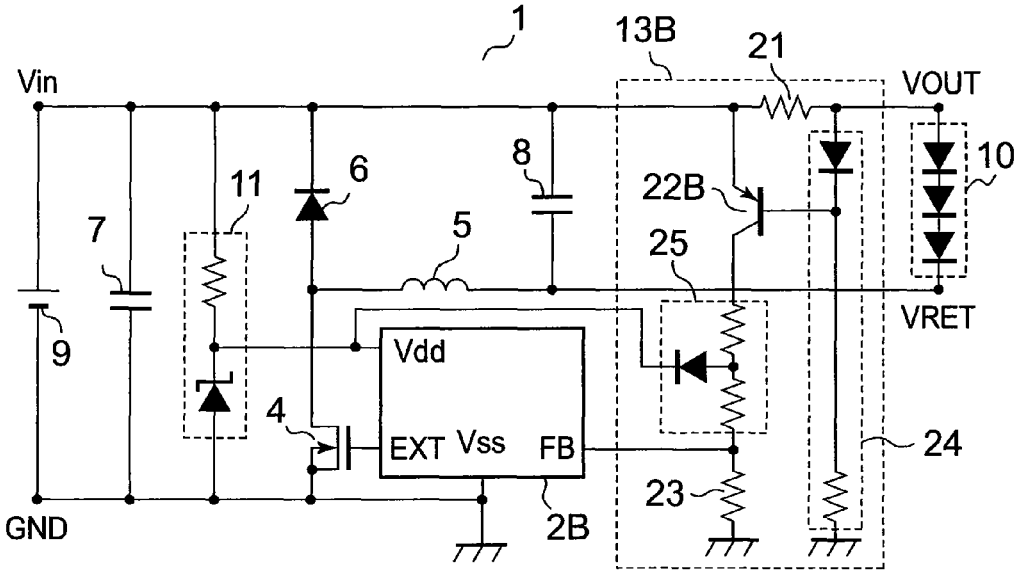
FIG. 6 is a circuit diagram illustrating a specific example of the LED drive circuit using the step-up switching regulator IC according to the second embodiment.
Figure 7:
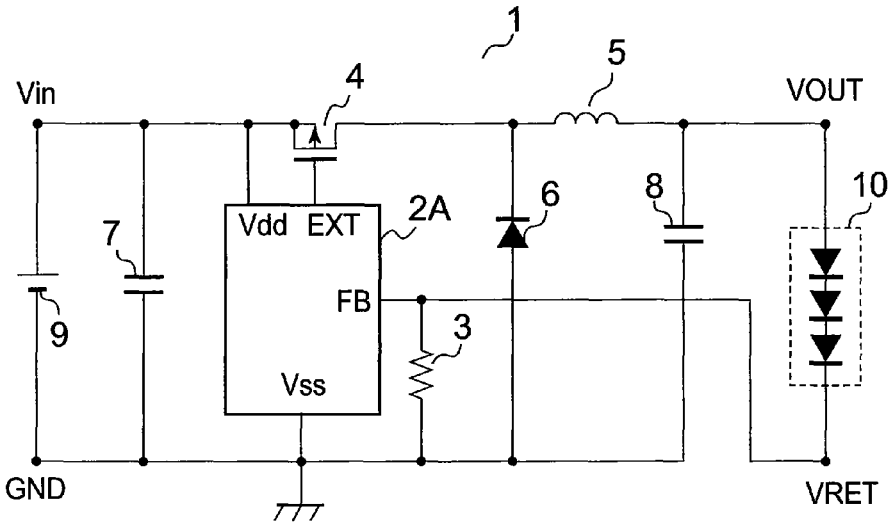
FIG. 7 PRIOR ART
FIG. 7 is a circuit diagram of an LED drive circuit using a conventional step-down switching regulator IC.
Figure 8:
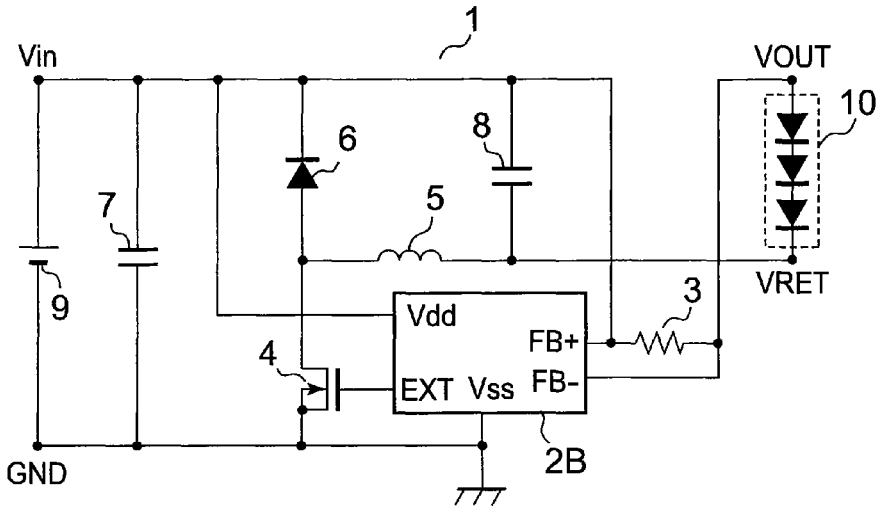
FIG. 8 PRIOR ART
FIG. 8 is a circuit diagram of an LED drive circuit using a conventional step-up switching regulator IC.

FIG. 6 illustrates a specific example of the LED drive circuit 1 using the step-up switching regulator IC 2B according to this embodiment. The current detecting circuit 13B of FIG. 6 is an example in which the current detecting circuit 13B of FIG. 5 is illustrated more specifically. The current detecting circuit 13B of FIG. 6 includes a bias circuit 24 and a voltage setting circuit 25. The bias circuit 24 includes a diode and a resistor, and applies a bias voltage to the base of the bipolar transistor 22B. The voltage setting circuit 25 includes a diode and resistors. The diode includes a cathode terminal connected to the power supply terminal Vdd, and has a function of accurately setting a voltage range of the voltage output from the current detecting circuit 13B.

The LED drive circuit 1 is configured in this manner, and thus, even when the voltage of the power supply 9 is 100 V, can set the voltage within a range of the operating voltage of the switching regulator IC 2B by the voltage clamp circuit 11. In addition, the LED drive circuit 1 can set the voltage output from the current detecting circuit 13B within the range of the operating voltage of the switching regulator IC 2B. Accordingly, the LED drive circuit 1 can use the switching regulator IC 2B having low breakdown voltage, whereby the LED drive circuit 1 can be manufactured at low cost.

Note that the first embodiment describes the example in which the current detecting resistor 21 is provided between the power supply input terminal GND and the terminal VRET. However, the similar effects as those of the first embodiment can be attained with the configuration in which the current detecting resistor 21 is provided between the power supply input terminal Vin and the output terminal VOUT as in the second embodiment. In such a case, the current detecting circuit 13A may have the configuration of the second embodiment. Further, the same holds true for the case where the current detecting resistor 21 is provided between the power supply input terminal GND and the terminal VRET in the second embodiment.

What is claimed is:

1. An LED drive circuit including a switching regulator IC having a breakdown voltage lower than a power supply voltage to be applied between power supply input terminals, for driving an LED by an output current controlled by the switching regulator IC, the LED drive circuit comprising:

a voltage clamp circuit for clamping the power supply voltage from a voltage of the one of the power supply input terminals which is located on a positive side to an operating voltage of the switching regulator IC and outputting the operation voltage; and a current detecting circuit for detecting a current flowing through the LED, and outputting a voltage obtained by converting the detected current into a voltage within a range of the operating voltage of the switching regulator IC, wherein the current detecting circuit comprises:

a current detecting resistor;

a bipolar transistor including a base and an emitter which are connected to both ends of the current detecting resistor;

a voltage setting circuit connected to a collector of the bipolar transistor; and a bias circuit connected to the base of the bipolar transistor;

wherein the switching regulator IC includes:

one power supply terminal connected to one of the power supply input terminals which has the same polarity as the one power supply terminal;

another power supply terminal connected to an output terminal of the voltage clamp circuit; and a feedback voltage input terminal connected to an output terminal of the current detecting circuit.

2. An LED drive circuit including a switching regulator IC having a breakdown voltage lower than a power supply voltage to be applied between power supply input terminals, for driving an LED by an output current controlled by the switching regulator IC, the LED drive circuit comprising:

a voltage clamp circuit for clamping the power supply voltage from a voltage of the one power supply input terminals which is located on a positive side to an operating voltage of the switching regulator IC and outputting the operating voltage, wherein the voltage clamp circuit includes:

a zener diode including a cathode connected to the one of the power supply input terminals which is located on the positive side; and a resistor connected between an anode of the zener diode and another of the power supply input terminals which is located on a ground side and a current detecting circuit for detecting a current flowing through the LED, and outputting a voltage obtained by converting the detected current into a voltage within a range of the operating voltage of the switching regulator IC, wherein the switching regulator IC includes:

one power supply terminal connected to one of the power supply input terminals which has the same polarity as the one power supply terminal;

another power supply terminal connected to an output terminal of the voltage clamp circuit; and a feedback voltage input terminal connected to an output terminal of the current detecting circuit.

3. An LED drive circuit including a switching regulator IC having a breakdown voltage lower than a power supply voltage to be applied between power supply input terminals, for driving an LED by an output current controlled by the switching regulator IC, the LED drive circuit comprising:

a voltage clamp circuit for clamping the power supply voltage from a voltage of the one of the power supply input terminals which is located on a ground side to an operating voltage of the switching regulator IC and outputting the operating voltage; and a current detecting circuit for detecting an current flowing through the LED, and outputting a voltage obtained by converting the detected current into a voltage within a range of the operating voltage of the switching regulator IC, wherein the current detecting circuit includes:

a current detecting resistor;

a bipolar transistor including a base and an emitter which are connected to both ends of the current detecting resistor;

a voltage setting circuit connected to a collector of the bipolar transistor; and a bias circuit connected to the base of the bipolar transistor, wherein the switching regulator IC includes:

one power supply terminal connected to one of the power supply input terminals which has the same polarity as the one power supply terminal;

another power supply terminal connected to an output terminal of the voltage clamp circuit; and a feedback voltage input terminal connected to an output terminal of the current detecting circuit.

4. An LED drive circuit according to claim 3, wherein the voltage clamp circuit includes:

a zener diode including an anode connected to the one of the power supply input terminals which is located on the ground side; and a resistor connected between a cathode of the zener diode and another of the power supply input terminals which is located on a positive side.

* * * * *